US008528290B2

(12) United States Patent
Oh

(10) Patent No.: US 8,528,290 B2
(45) Date of Patent: Sep. 10, 2013

(54) FLOORING ARTICLE

(75) Inventor: Kwang Seok Oh, Busan (KR)

(73) Assignees: Oh Kwang Seok, Busan (KR); Sunchang Corporation, Incheon (KR)

( * ) Notice: Subject to any disclaimer, the term of this patent is extended or adjusted under 35 U.S.C. 154(b) by 11 days.

(21) Appl. No.: 13/258,734

(22) PCT Filed: Mar. 12, 2010

(86) PCT No.: PCT/KR2010/001560

§ 371 (c)(1),
(2), (4) Date: Sep. 20, 2011

(87) PCT Pub. No.: WO2010/114236

PCT Pub. Date: Oct. 7, 2010

(65) Prior Publication Data

US 2012/0017534 A1 Jan. 26, 2012

(30) Foreign Application Priority Data

Mar. 31, 2009 (KR) ..... 10-2009-0027225

(51) Int. Cl.
*E04B 2/00* (2006.01)

(52) U.S. Cl.
USPC ..... 52/588.1; 52/590.2; 52/591.1; 52/592.1

(58) Field of Classification Search
USPC ..... 52/582.1, 582.2, 586.1, 586.2, 587.1, 52/588.1, 585.1, 392, 539, 590.1–590.3, 52/592.1, 592.4, 591.1–591.5; 403/375, 403/381, 345, 266, 265, 267, 268, 271, 272, 403/364, 282
See application file for complete search history.

(56) References Cited

U.S. PATENT DOCUMENTS

| | | | | |
|---|---|---|---|---|
| 6,418,683 | B1 * | 7/2002 | Martensson et al. | 52/282.1 |
| 6,601,359 | B2 * | 8/2003 | Olofsson | 52/588.1 |
| 6,681,820 | B2 * | 1/2004 | Olofsson | 144/368 |
| 6,769,219 | B2 | 8/2004 | Schwitte et al. | |

(Continued)

FOREIGN PATENT DOCUMENTS

| | | |
|---|---|---|
| JP | 07-048853 | 11/1995 |
| JP | 2003-524717 | 8/2003 |
| KR | 20-0394593 | 9/2005 |

OTHER PUBLICATIONS

Korean Intellectual Property Office, International Search Report for International Application No. PCT/KR2010/001560, Oct. 28, 2010.

*Primary Examiner* — Brian Glessner
*Assistant Examiner* — Adam Barlow
(74) *Attorney, Agent, or Firm* — Sherr & Jiang, PLLC

(57) ABSTRACT

Disclosed is a floorboard to provide simplified assembly of flooring panels without damage and achieve enhanced horizontal coupling force. The floorboard includes a tongue part provided at a first flooring panel and a recessed part provided at a second flooring panel. The tongue part includes a tongue protrusion, a tongue bottom portion, and a raised retaining portion protruding downward from the tongue bottom portion. The recessed part includes an upper lip caught by the tongue protrusion when the tongue part is inserted into the recessed part, a lower lip, a raised portion protruding upward from an end of the lower lip, and a guide wall defining an inner wall of the recessed part and having the same contour as an arc drawn by an end of the tongue protrusion as the tongue part introduced between the upper and lower lips is pivotally rotated.

15 Claims, 13 Drawing Sheets

(56) References Cited

U.S. PATENT DOCUMENTS

| | | | | |
|---|---|---|---|---|
| 6,854,235 | B2 * | 2/2005 | Martensson | 52/601 |
| 6,880,307 | B2 | 4/2005 | Schwitte et al. | |
| 7,596,920 | B2 * | 10/2009 | Konstanczak | 52/589.1 |
| 7,763,143 | B2 * | 7/2010 | Boucke | 156/304.5 |
| 7,886,497 | B2 * | 2/2011 | Pervan | 52/588.1 |
| 2004/0250495 | A1 * | 12/2004 | Manthei | 52/589.1 |
| 2006/0236642 | A1 | 10/2006 | Pervan | |
| 2008/0034701 | A1 * | 2/2008 | Pervan | 52/588.1 |
| 2008/0199676 | A1 * | 8/2008 | Bathelier et al. | 428/223 |
| 2009/0249731 | A1 * | 10/2009 | Cappelle | 52/588.1 |

* cited by examiner

FLOORING ARTICLE

CROSS REFERENCE TO PRIOR APPLICATIONS

This application is a National Stage Patent Application of PCT International Patent Application No. PCT/KR2010/001560 (filed on Mar. 12, 2010) under 35 U.S.C. §371, which claims priority to Korean Patent Application No. 10-2009-0027225 (filed on Mar. 31, 2009), which are all hereby incorporated by reference in their entirety.

BACKGROUND OF THE INVENTION

1. Field of the Invention

The present invention relates to floorboard, and more particularly, to a flooring panel assembly having mechanical coupling elements, which is mounted to the floors of buildings, etc.

2. Description of the Related Art

In general, flooring panels are used to decorate the floors of buildings. Although flooring panels made of synthetic resins have conventionally been used, flooring panels made of wood are increasingly used in recent years to provide a more aesthetically pleasing appearance and excellent functions.

There is known a wood flooring panel, which is configured in such a manner that a fastening structure is provided at a long or short side of the flooring panel to ensure that opposite sides of neighboring flooring panels are assembled with each other, in order to assure easy assembly between flooring panels and consequently, enhanced construction efficiency.

FIG. 1 is a view illustrating an assembly relationship between two flooring panels of a conventional floorboard.

Specifically, as illustrated in FIG. 1, in the case of the conventional floorboard, a first flooring panel 1 and a second flooring panel 2 are assembled with each other as a tongue part 20 of the second flooring panel 2 is coupled with a recessed part 10 of the first flooring panel 1. To this end, the tongue part 20 is first horizontally introduced into the recessed part 10 and then, is pivotally rotated downward by a predetermined angle about a pivot point A.

More particularly, the tongue part 20 is introduced into the recessed part 10 in a substantially horizontal direction until a tip protruding portion 21 of the tongue part 20 is fitted into a recess 11 of the recessed part 10 and at this time, the tongue part 20 comes into contact with the recessed part 10 at the pivot point A.

The tongue part 20 includes a retaining portion 22, which protrudes downward by a predetermined length. Also, when the tongue part 20 is introduced into the recessed part 10, an upper lip 15 of the recessed part 10 and a front surface portion 25 of the tongue part 20 come into contact with each other at a point. This contact point is the pivot point A.

If the tongue part 20 is rotated along an arc B designated by a dotted line in FIG. 1 about the pivot point A, the retaining portion 22 of the tongue part 20 is fitted into and seated in a retaining recess 13 of the recessed part 10 to ensure coupling between the tongue part 20 and the recessed part 10.

That is, the tongue part 20 is coupled with the recessed part 10 as it is pivotally rotated along the arc B about the pivot point A.

However, in the above described coupling manner, to prevent an inner wall 12*a* of a raised portion 12 provided at an end of the recessed part 10 from hindering rotation of an outer wall 22*a* of the retaining portion 22 when the outer wall 22*a* of the retaining portion 22 is pivotally rotated and inserted into the retaining recess 13 along the arc B, the inner wall 12*a* of the protrusion 12 must be configured such that an angle C between the inner wall 12*a* and a horizontal plane has a gentle gradient.

In other words, if the angle C has a steep gradient, the outer wall 22*a* of the retaining portion 22 may fail to pass the inner wall 12*a* of the raised portion 12, thus making coupling of the tongue part 20 difficult and also, it is necessary to apply sufficient external force to interference-fit the retaining portion 22 of the tongue part 20 to the raised portion 12 of the recessed part 10 when the tongue part 20 is coupled with the recessed part 10, which causes damage to the flooring panels and makes it difficult to assemble the flooring panels.

However, the gentle gradient angle C of the protrusion 12 problematically provides weak coupling force in a horizontal direction even if the tongue part 20 is coupled with the recessed part 10.

In the case where the above described coupling structure is applied to a modern heating system using a heating element (e.g., an electric film or an electric panel) in a simplified construction manner, moreover, a constituent material of a floorboard (conventionally, plywood, Particle Board (PB), Medium Density Fiberboard (MDF), High Density Fiberboard (HDF), etc.) may be severely contracted or expanded due to rapid temperature increase generated when the heating system installed beneath the floorboard is turned on, thereby causing expansion of the recessed part 10, and especially, causing the raised portion 12 to be severely deformed to a state designated by reference numeral 12-1 as illustrated in FIG. 1. This may cause the outer wall 22*a* of the retaining portion 22 to be separated from the inner wall 12*a* of the raised portion 12, resulting in an unwanted separation of two flooring panels.

SUMMARY OF THE INVENTION

Therefore, the present invention has been made in view of the above problems, and it is an object of the present invention to provide a floorboard in which neighboring flooring panels are assembled with each other using a new assembly method completely different from a conventional flooring panel assembly method, the floorboard providing simplified assembly of flooring panels without damage because it is unnecessary to apply external force to assemble the flooring panels and resulting in enhanced coupling force in a horizontal direction after assembly of the flooring panels.

In accordance with one aspect of the present invention, the above and other objects can be accomplished by the provision of a floorboard including a tongue part protruding from one side of a first flooring panel and a recessed part provided at one side of a second flooring panel for insertion and assembly of the tongue part, wherein the tongue part includes a tongue protrusion having a predetermined length, a tongue bottom portion extending from the tongue protrusion to define the bottom of the tongue part, and a raised retaining portion protruding downward from the tongue bottom portion, wherein the recessed part includes an upper lip defining the ceiling of the recessed part, the tongue protrusion being caught by the upper lip as the tongue part is inserted into and rotated in the recessed part, a lower lip defining a bottom portion of the recessed part, a raised portion protruding upward from an end of the lower lip, and a guide wall defining an inner wall of the recessed part, the guide wall having the same contour as an arc drawn by an end of the tongue protrusion as the tongue part is introduced into a space between the upper lip and the lower lip and is pivotally rotated about a contact point with respect to the raised portion, and wherein a space is defined by the guide wall and lower lip such that an upper corner of the tongue part is located below the upper lip and the raised retaining portion is located inside the raised portion when the tongue part is inserted into the recessed part.

In accordance with another aspect of the present invention, there is provided a floorboard including a tongue part protruding from one side of a first flooring panel and a recessed part provided at one side of a second flooring panel for insertion and assembly of the tongue part, wherein the recessed part includes an upper lip defining the ceiling of the recessed part, a lower lip defining a bottom portion of the recessed part, and a raised portion protruding upward from an end of the lower lip, wherein the tongue part includes a tongue protrusion configured to be caught by the upper lip as the tongue part is inserted into and is pivotally rotated upward in the recessed part, a tongue bottom portion extending from the tongue protrusion to define the bottom of the tongue part, and a raised retaining portion protruding downward from the tongue bottom portion, and wherein, when the tongue part is inserted into and is pivotally rotated in the recessed part, the raised retaining portion comes into contact with an inner wall of the raised portion to slide downward along the inner wall of the raised portion and an end of the tongue protrusion is pivotally rotated upward toward a lower end of the upper lip such that the tongue protrusion is caught by the upper lip to ensure that the tongue part is assembled with the recessed part.

In accordance with a further aspect of the present invention, there is provided a floorboard including a tongue part protruding from one side of a first flooring panel and a recessed part provided at one side of a second flooring panel for insertion and assembly of the recessed part, wherein the recessed part includes an upper lip defining the ceiling of the recessed part, a lower lip defining a bottom portion of the recessed part, and a raised portion protruding upward from an end of the lower lip, wherein the tongue part includes a tongue protrusion configured to be caught by the upper lip as the tongue part is inserted into and is pivotally rotated upward in the recessed part, a tongue bottom portion extending from the tongue protrusion to define the bottom of the tongue part, and a raised retaining portion protruding downward from the tongue bottom portion, and wherein the recessed part further includes a space in which the tongue protrusion is located below the upper lip, the raised retaining portion is located inside the raised portion, and the tongue bottom portion comes into contact with or is located close to the bottom portion of the recessed part when the tongue part is inserted into the recessed part.

BRIEF DESCRIPTION OF THE DRAWINGS

The above and other objects, features and other advantages of the present invention will be more clearly understood from the following detailed description taken in conjunction with the accompanying drawings, in which.

DETAILED DESCRIPTION OF THE INVENTION

Hereinafter, exemplary embodiments of the floorboard according to the present invention will be described in more detail with reference to the accompanying drawings.

First, a basic configuration of the floorboard according to the embodiment of the present invention will be schematically described with reference to FIG. 2.

Preferably, the floorboard according to the present invention is basically made of wood, plywood, MDF, HDF, PB, PVC, and mixtures thereof.

Here, MDF is an abbreviation for Medium Density Fiberboard, HDF is an abbreviation for High Density Fiberboard, PB is an abbreviation for Particle Board, and PVC is an abbreviation for Poly Vinyl Chloride.

The floorboard according to the present invention is constructed by assembling a plurality of flooring panels with one another. Each flooring panel has long sides and short sides, each of which is provided with an assembly structure.

As such, any one flooring panel may be assembled with another flooring panel through connection at the short sides and may be assembled with a further flooring panel through connection at the long sides, to construct the entire floorboard.

Of course, assembly structures are not essentially provided respectively at all the long sides and the short sides of the flooring panel. For example, assembly structures may be provided only at the short sides or at the long sides of a flooring panel.

Figure 1:
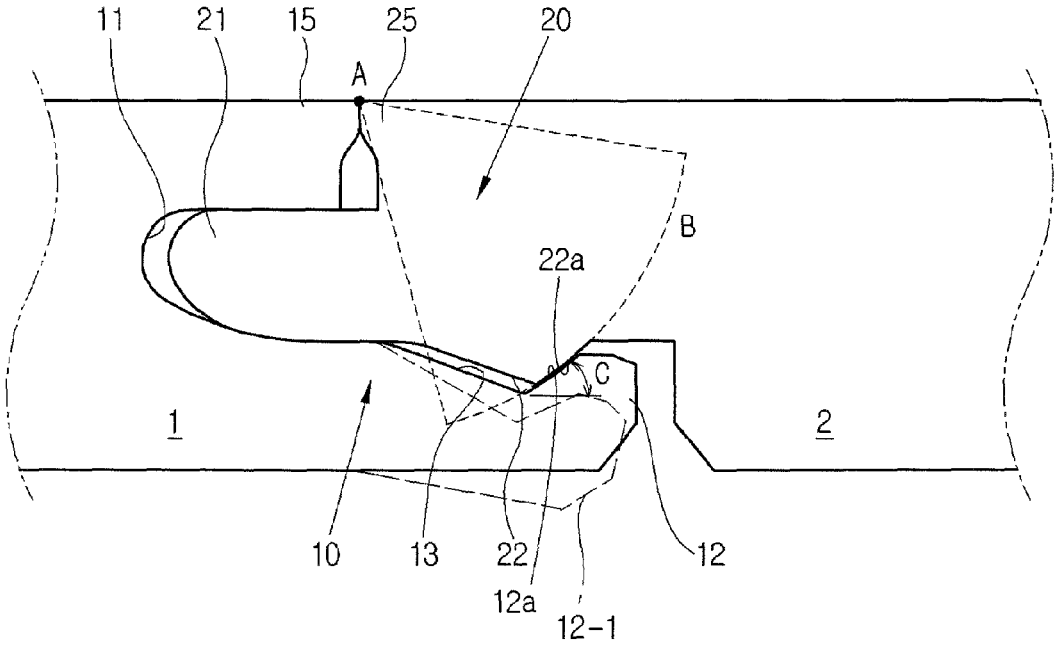
FIG. 1 is a side sectional view illustrating an assembly relationship between two flooring panels of a conventional floorboard.
Figure 2:
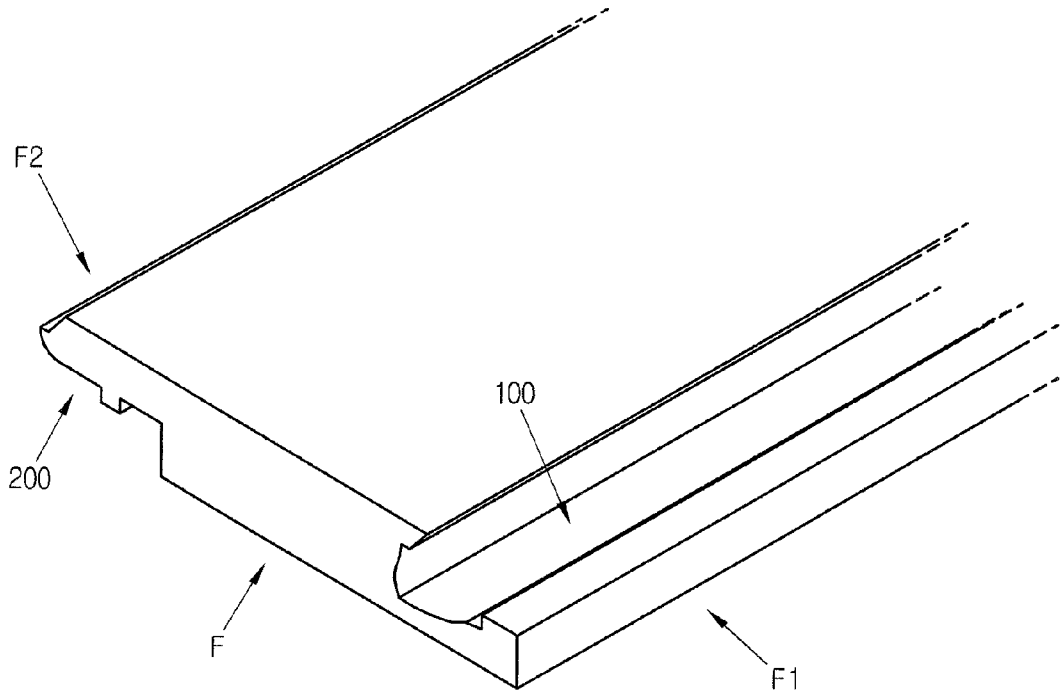
FIG. 2 is a perspective view illustrating one flooring panel of a floorboard according to an embodiment of the present invention.

Referring to FIG. 2 illustrating a flooring panel according to one embodiment, the flooring panel F is provided at one side thereof with a first assembly structure F1 and at the other side thereof with a second assembly structure F2.

The first assembly structure F1 of the flooring panel F is coupled with a second assembly structure (not shown) of another flooring panel. The second assembly structure F2 of the flooring panel F is coupled with a first assembly structure (not shown) of a further flooring panel.

The first assembly structure F1 includes a recessed part 100 and the second assembly structure F2 includes a tongue part 200. The recessed part 100 includes a predetermined space and a coupling structure for insertion and assembly of a tongue part (not shown) of another flooring panel. The tongue part 200 includes a protruding structure to be inserted into the space of a recessed part (not shown) of a further flooring panel.

More detailed configurations of the recessed part 100 and the tongue part 200 will be described later.

The floorboard according to the embodiment of the present invention may further include a decorative layer provided at an upper end U or a lower end L of each flooring panel F to provide the floorboard with an aesthetically pleasing appearance, and a protective layer to protect the decorative layer or the flooring panel F.

Alternatively, the decorative layer and the protective layer may be provided at both the upper end U and the lower end L of the flooring panel F.

Next, the configuration and assembly sequence of the floorboard according to one embodiment of the present invention will be described in more detail with reference to FIGS. 3 to 8.

Figure 3:
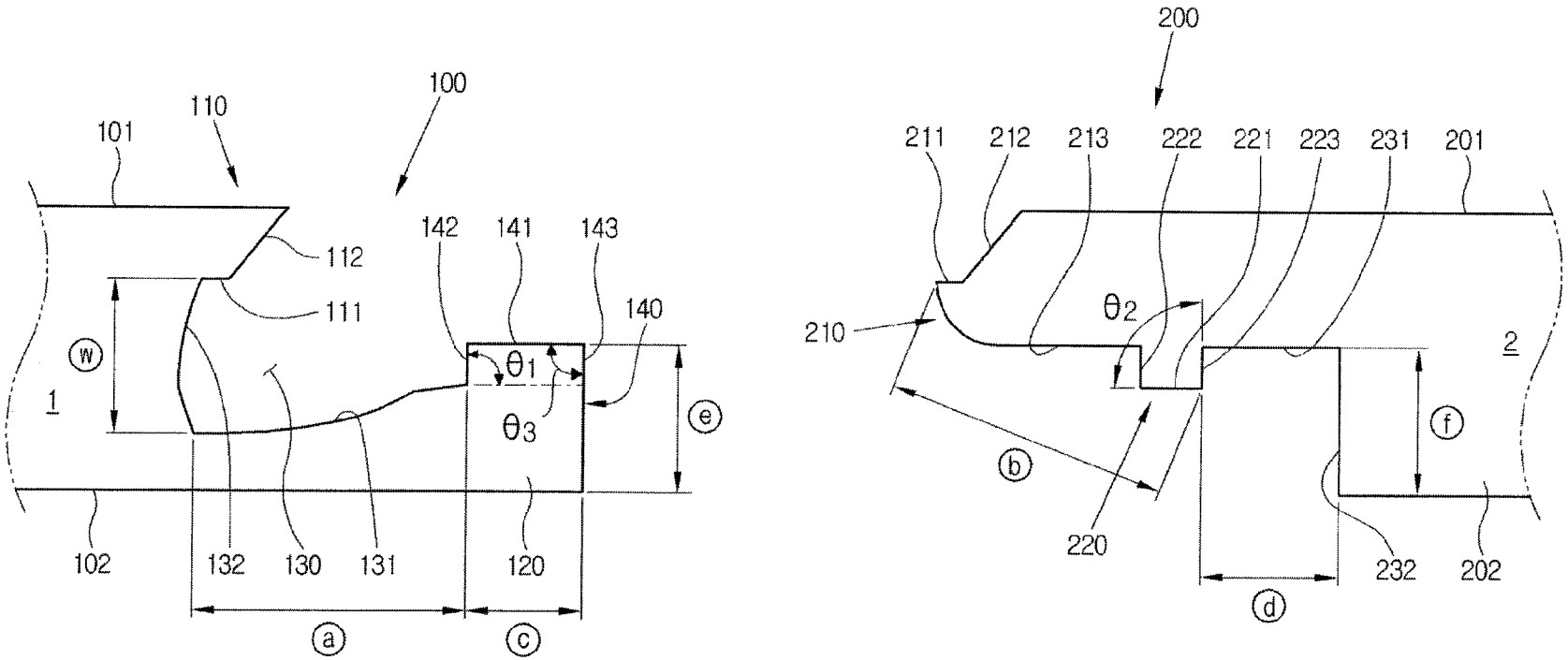
FIG. 3 is a side sectional view illustrating a recessed part and a tongue part provided in the floorboard according to one embodiment of the present invention in more detail.

The floorboard according to the present invention includes the recessed part 100 and the tongue part 200. FIG. 3 illustrates the recessed part 100 provided in a first flooring panel 1 and the tongue part 200 provided in a second flooring panel 2.

As illustrated in FIG. 3, the recessed part 100 may include an upper lip 110, a lower lip 120, a space 130, and a raised portion 140.

The upper lip 110 protrudes from a lateral edge of an upper end 101 of the first flooring panel 1 by a predetermined length, thereby defining a ceiling portion 111 of the recessed part 100.

The lower lip 120 protrudes from a lateral edge of a lower end 102 of the first flooring panel 1 by a greater length than the upper lip 110, thereby defining a bottom portion 131 of the recessed part 100.

The upper lip 110 and the lower lip 120 are spaced apart from each other by a predetermined distance. The space 130 is a space defined between the upper lip 110 and the lower lip 120 for insertion and assembly of the tongue part 200.

The raised portion 140 protrudes upward from an end of the lower lip 120. When the tongue part 200 is inserted into the space 130, the raised portion 140 provides horizontal coupling force with respect to the tongue part 200.

The space 130 is defined by the ceiling portion 111 of the upper lip 110, the bottom portion 131 of the lower lip 120, and a guide wall 132.

The guide wall 132 serves as an inner wall of the recessed part 10, more particularly, an inner wall of the space 130. A more detailed configuration of the guide wall 132 will be described later.

The upper lip 110 includes the ceiling portion 111 and a guide portion 112. The ceiling portion 111 preferably provides a substantially horizontal surface and the guide portion 112 preferably provides an inclined surface protruding outward from the ceiling portion 111.

The guide portion 112 serves to guide the tongue part 200 when the tongue part 200 is introduced into the space 130. This will be described later in detail.

As illustrated in FIG. 3, the tongue part 2Q0 may include a tongue protrusion 210, a raised retaining portion 220, and an accommodating portion 230.

The tongue protrusion 210 is configured to be caught by the ceiling portion 111 of the upper lip 110 as the tongue part 200 is inserted into the recessed part 100 and is pivotally rotated upward.

The tongue protrusion 210 includes a hook portion 211 corresponding to the ceiling portion 111 of the upper lip 110 of the recessed part 100, an extension portion 212 extending upward from the hook portion 211 and corresponding to the guide portion 112 when the hook portion 211 is caught by the ceiling portion 111, and a tongue bottom portion 213 extending downward from the hook portion 211 to define a bottom portion of the tongue protrusion 210.

The raised retaining portion 220 protrudes downward from the tongue bottom portion 213. When the tongue part 200 is inserted into the recessed part 100, the raised retaining portion 220 is caught by the raised portion 140 of the recessed part 100, thereby serving to provide horizontal coupling force of the floorboard in cooperation with the raised portion 140.

The accommodating portion 230 is configured to accommodate the raised portion 140 of the recessed part 100 when the tongue part 200 is inserted into the recessed part 100.

In the floorboard according to the embodiment illustrated in FIG. 3, horizontal coupling force of the floorboard is provided by the raised portion 140 and the raised retaining portion 220. More particularly, horizontal coupling force of the floorboard is provided as an inner wall 142 of the raised portion 140 comes into contact with an outer wall 223 of the raised retaining portion 220.

Preferably, an angle $\theta_1$ between the inner wall 142 of the raised portion 140 and a horizontal plane is substantially in a range of $80° \leqq \theta_1 \leqq 100°$, and an angle $\theta_2$ between a lower end 221 and the outer wall 223 of the raised retaining portion 220 is substantially in a range of $80° \leqq \theta_2 \leqq 100°$ More preferably, the angle $\theta_1$ between the inner wall 142 of the raised portion 140 and a horizontal plane is substantially 90°, which can enhance coupling force between the recessed part 100 and the tongue part 200.

That is, the inner wall 142 of the raised portion 140 is oriented in a substantially vertical direction, and the outer wall 223 of the raised retaining portion 220 is oriented in a substantially vertical direction, which can provide extremely strong coupling force in a horizontal direction.

In addition, preferably, a height of the raised portion 140, i.e. a length ⓔ from an upper end 141 of the raised portion 140 to the lower end 102 of the first flooring panel 1 is substantially equal to a length ⓕ from a ceiling portion 231 of the accommodating portion 230 to a lower end 202 of the second flooring panel 2.

The raised retaining portion 220 protrudes downward from the ceiling portion 231 of the accommodating portion 230.

As such, a vertical length from a lower end 221 of the raised retaining portion 220 of the tongue part 200 to the lower end 202 of the second flooring panel 2 must always be less than a length of an outer wall 143 of the raised portion 140 of the recessed part 100. Therefore, when the tongue part 200 is horizontally introduced into the recessed part 100, an inner wall 222 of the raised retaining portion 220 of the tongue part 200 is caught by the outer wall 143 of the raised portion 140, which prevents the tongue part 200 from being introduced into the recessed part 100.

In addition, as illustrated in FIG. 3, an angle $\theta_3$ between the upper end 141 and the outer wall 143 of the raised portion 140 is preferably substantially in a range of $80° \leqq \theta_3 \leqq 100°$, in other words, is preferably substantially at a right angle. Therefore, horizontally coupling the tongue part 200 with the recessed part 100 is impossible.

For this reason, in order to introduce and assemble the tongue part 200 into the recessed part 100, it is necessary to pivotally rotate the tongue part 200 upward such that the tongue part 200 is obliquely inserted into the space 130 of the recessed part 100.

In this case, a distance between the upper lip 110 and the raised portion 140 of the recessed part 100 must be sufficient to allow the oblique introduction of the tongue part 200, but an excessive distance therebetween is undesirable.

For example, the distance between the upper lip 110 and the raised portion 140 of the recessed part 100 and the height of the raised portion 140 are preferably determined in consideration of a relationship with regard to the tongue part 200. This will be described below with reference to FIG. 4.

Figure 4:
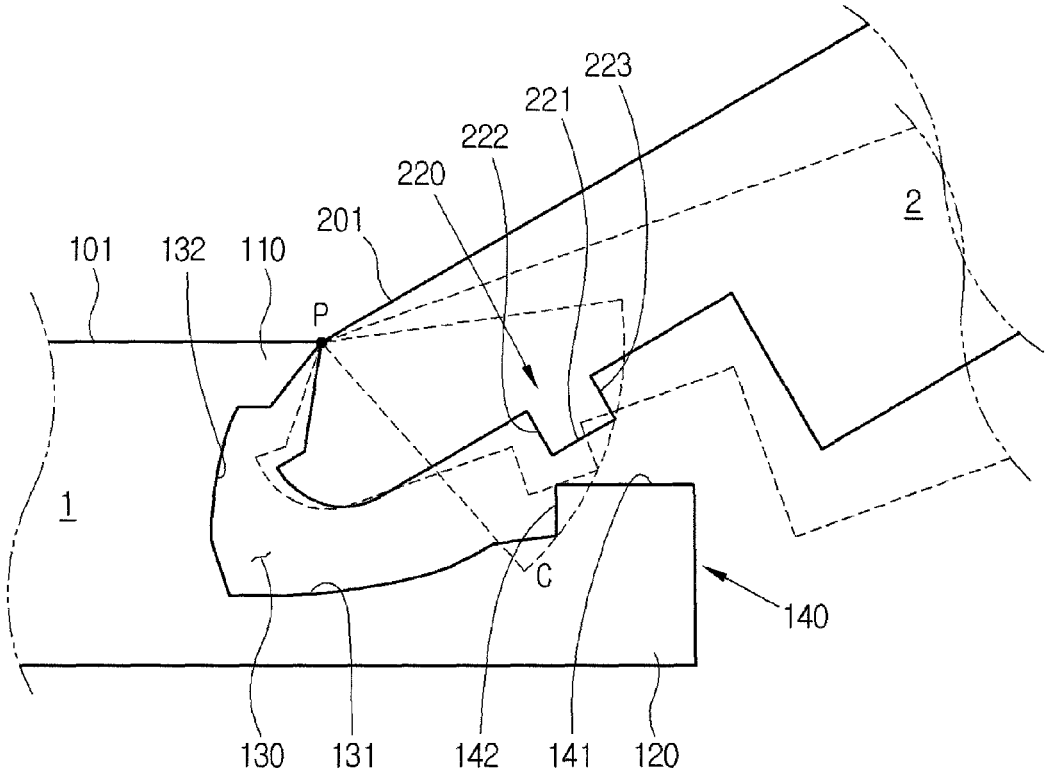
FIG. 4 is a side sectional view explaining a difference between the conventional floorboard and the floorboard according to the embodiment illustrated in FIG. 3.

As illustrated in FIG. 4, to insert the tongue part 200 into the recessed part 100, the second flooring panel 2 is pivotally rotated upward such that the tongue part 200 is inserted into the space 130. This serves to prevent the inner wall 222 of the raised retaining portion 220 from being caught by the outer wall 143 of the raised portion 140.

When the tongue part 200 is inserted into the recessed part 100, as illustrated in FIG. 4, an end of the upper lip 110 of the recessed part 100 (more particularly, an end of the guide portion 112 as illustrated in FIG. 3) and an upper corner E (see FIG. 5) of the tongue part 200 (more particularly, a corner where the upper end 201 and the extension portion 212 as illustrated in FIG. 3 meet each other) come into contact with each other at a point, and this contact point is a pivot point P. If the tongue part 200 is pivotally rotated downward about the pivot point P, the raised retaining portion 220 of the tongue part 200 is caught by the raised portion 140 of the recessed part 100.

More specifically, if the tongue part 200 is pivotally rotated downward about the pivot point P, an arc C illustrated in FIG. 4 is drawn.

In this case, the arc C is drawn by rotation of a corner R (see FIG. 6) where the lower end 221 and the outer wall 223 of the raised retaining portion 220 of the tongue part 200 meet each other.

The floorboard according to the embodiment of the present invention has a feature in that the recessed part 100 and the tongue part 200 are configured such that the arc C passes through the upper end 141 of the raised portion 140.

In other words, the upper lip 110, the lower lip 120 and the raised portion 140 are preferably configured such that the arc C drawn by the corner R of the raised retaining portion 220 of the tongue part 200 passes through the upper end 141 of the raised portion 140 when the tongue part 200 is pivotally rotated about the pivot point P along the arc C as illustrated in FIG. 4.

With the above described configuration, however, it is impossible to couple the tongue part 200 with the recessed part 100 by pivotally rotating the tongue part 200 about the pivot point P as illustrated in FIG. 4.

The floorboard according to the present invention has a feature of allowing the tongue part 200 and the recessed part 100 to be coupled with each other in a manner different from the above described assembly manner, despite of the above described configuration that makes assembly of the tongue part 200 and the recessed part 100 difficult.

Hereinafter, an assembly sequence of the recessed part 100 and the tongue part 200 of the floorboard according to the embodiment will be described with reference to FIGS. 3 and 5 to 8.

Figure 5:
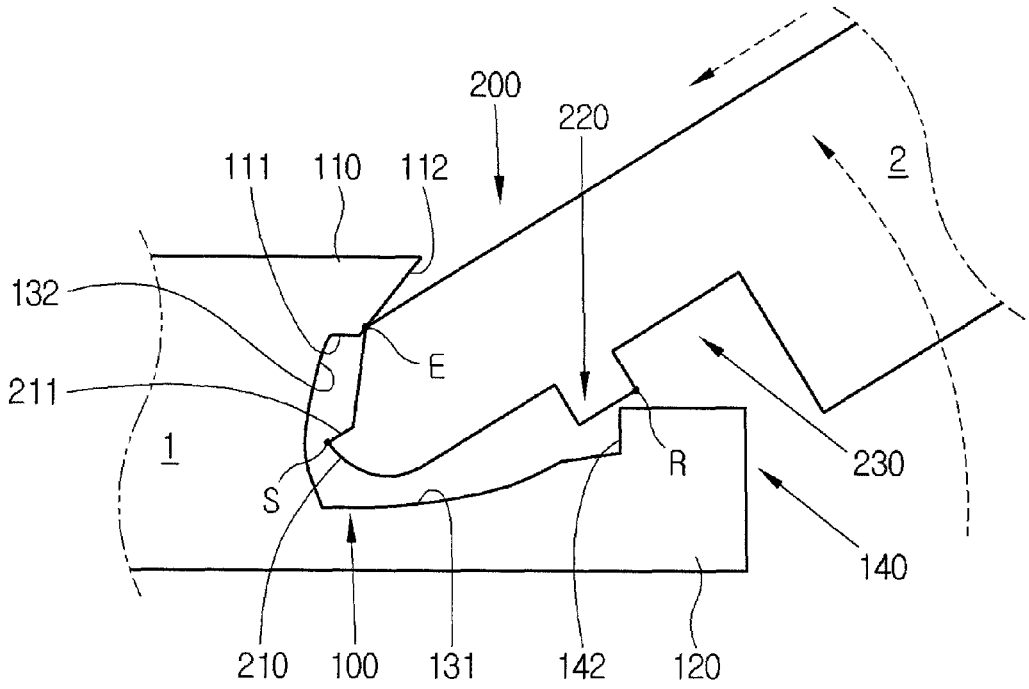
FIGS. 5 to 8 are side sectional views illustrating a stepwise coupling sequence of the tongue part and the recessed part provided in the floorboard according to the embodiment illustrated in FIG. 3.
Figure 6:
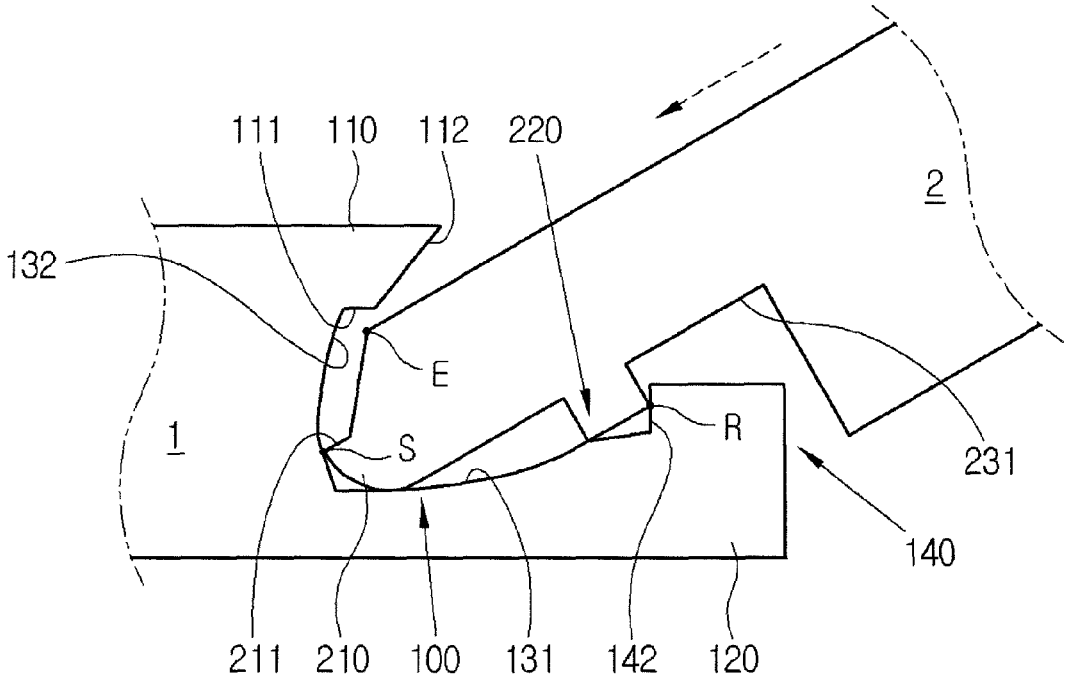

As illustrated in FIGS. 5 and 6, to couple the tongue part 200 and the recessed part 100 of the floorboard with each other according to the embodiment of the present invention, in a state in which the tongue part 200 is pivotally rotated upward so as to be obliquely oriented, it is necessary to move the upper corner E of the tongue part 200 downward along the guide portion 112 of the upper lip 110 and simultaneously, to completely introduce the tongue protrusion 210 and the raised retaining portion 220 into the space 130

In this case, the tongue bottom portion 213 of the tongue protrusion 210 may come into contact with the bottom portion 131 of the recessed part 100, or may be located close to the bottom portion 131.

More specifically, once the tongue part 200 is completely introduced into the space 130 of the recessed part 100, the upper corner E of the tongue part 200 is located below the ceiling portion 111 of the upper lip 100 and the raised retaining portion 220 is located inside the inner wall 142 of the raised portion 140 (see FIG. 6).

Thus, the space 130 of the recessed part 100 must have a sufficient size to allow the tongue protrusion 210 of the tongue part 200 to be located below the upper lip 110 and the raised retaining portion 220 to be located inside the inner wall 142 of the raised portion 140 as described above.

In this case, as illustrated in FIG. 3, a width ⓐ of the bottom portion 131 of the recessed part 100 is preferably substantially equal to or greater than a length ⓑ from an end S of the tongue protrusion 210 of the tongue part 200 to the corner R where the lower end 221 and the outer wall 223 of the raised retaining portion 220 meet each other.

In addition, as illustrated in FIG. 6, once the tongue part 200 is completely introduced into the recessed part 100, preferably, the end S of the tongue protrusion 210 comes into contact with or is located close to the guide wall 132 of the recessed part 100, and the corner R of the raised retaining portion 220 comes into contact with or is located close to the inner wall 142 of the raised portion 140.

Figure 7:
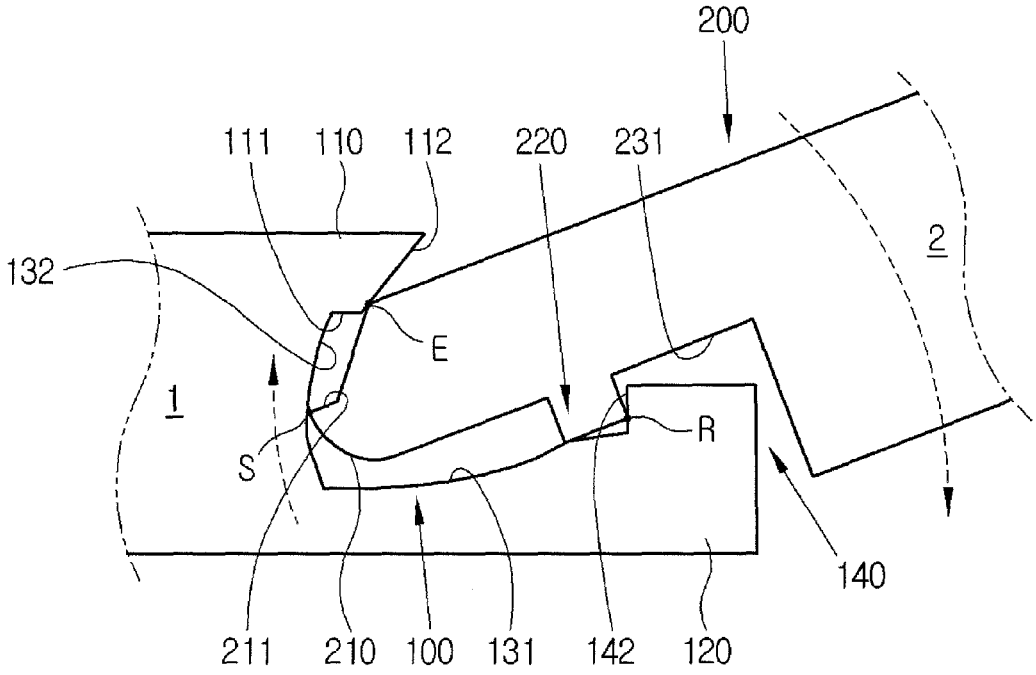

Then, referring to FIG. 7, after the tongue part 200 is completely inserted into the space 130 of the recessed part 100 as illustrated in FIGS. 5 and 6, the tongue part 200 is pivotally rotated such that the tongue protrusion 210 is moved upward.

In this case, the end S of the tongue protrusion 210 is moved upward along the guide wall 132 and the outer corner R of the raised retaining portion 220 is moved downward along the inner wall 142 of the raised portion 140.

In other words, the guide wall 132 of the recessed part 100 guides movement of the end S of the tongue protrusion 210 of the tongue part 200, and the inner wall 142 of the raised portion 140 guides movement of the raised retaining portion 200. A more detailed guiding mechanism will be described later with reference to FIGS. 9 and 10.

In addition, the upper corner E of the tongue part 200 is preferably moved upward along the guide portion 112 of the upper lip 110.

Figure 8:
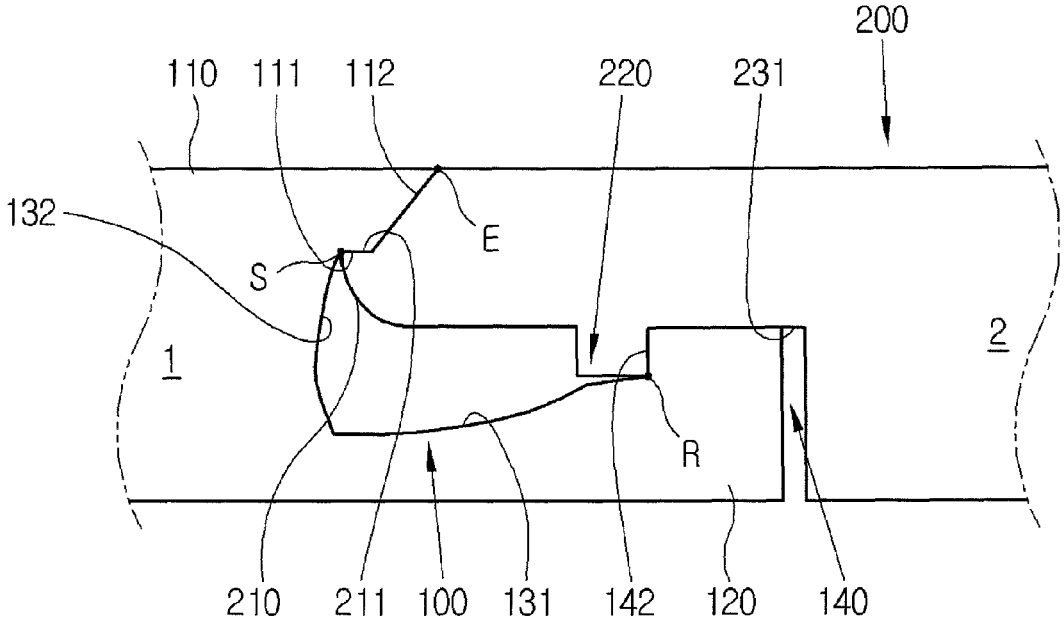

Then, if the hook portion 211 of the tongue protrusion 210 comes into contact with the ceiling portion 111 of the upper lip 110 via the above described rotation, as illustrated in FIG. 8, the tongue part 200 is completely coupled with the recessed part 100.

After completion of the coupling between the tongue part 200 and the recessed part 100, as illustrated in FIG. 8, a space having a predetermined volume is defined by the bottom portion 131 and the guide wall 132 of the recessed part 100 and the tongue bottom portion 213 of the tongue part 200.

Also, after completion of the coupling between the tongue part 200 and the recessed part 100, as illustrated in FIG. 8, the raised portion 140 is accommodated in the accommodating portion 230. In this case, the upper end 141 of the raised portion 140 preferably comes into contact with the ceiling portion 231 of the accommodating portion 230.

This configuration can be realized when the length ⓔ from the upper end 141 of the raised portion 140 to the lower end 102 of the first flooring panel 1 is substantially equal to the length ⓕ from the ceiling portion 231 of the accommodating portion 230 to the lower end 202 of the second flooring panel 2.

Also, a width ⓒ of the raised portion 140 is preferably less than a width ⓓ of the accommodating portion 230. Specifically, after completion of the coupling between the tongue part 200 and the recessed part 100, as illustrated in FIG. 8, the raised portion 140 is preferably accommodated in the accommodating portion 230 with a slight gap therebetween.

In the meantime, as illustrated in FIG. 3, a length (w) of the guide wall 132 is preferably greater than a vertical length from the hook portion 211 of the tongue protrusion 210 to the lower end 221 of the raised retaining portion 220.

Here, with regard to the bottom portion 131 of the recessed part 100, a part thereof near the guide wall 132 preferably has a different height from that of a part thereof near the raised portion 140.

Specifically, the bottom portion 131 of the recessed part 100 is preferably gradually reduced in height from the inner wall 142 of the raised portion 140 to the guide wall 132.

That is, as illustrated in FIG. 3, the height of the bottom portion 131 near the guide wall 132 is less than the height of the bottom portion 131 near the raised portion 140.

In the case where the length (w) of the guide wall 132 is greater than the vertical length from the hook portion 211 to the lower end 221 and the height of the bottom portion 131 near the guide wall 132 is less than that of the remaining bottom portion, as illustrated in FIG. 6, as the tongue part 200 is inserted into the space 130 of the recessed part 100, the tongue protrusion 210 can be located below the upper lip 110 and the raised retaining portion 220 can be located inside the inner wall 142 of the raised portion 140, which ensures that the tongue part 200 can be completely deeply inserted into the recessed part 100.

Next, a mechanism by which the tongue part 200 is inserted into and rotated in the recessed part 100 will be described in detail with reference to FIGS. 9 and 10.

Figure 9:
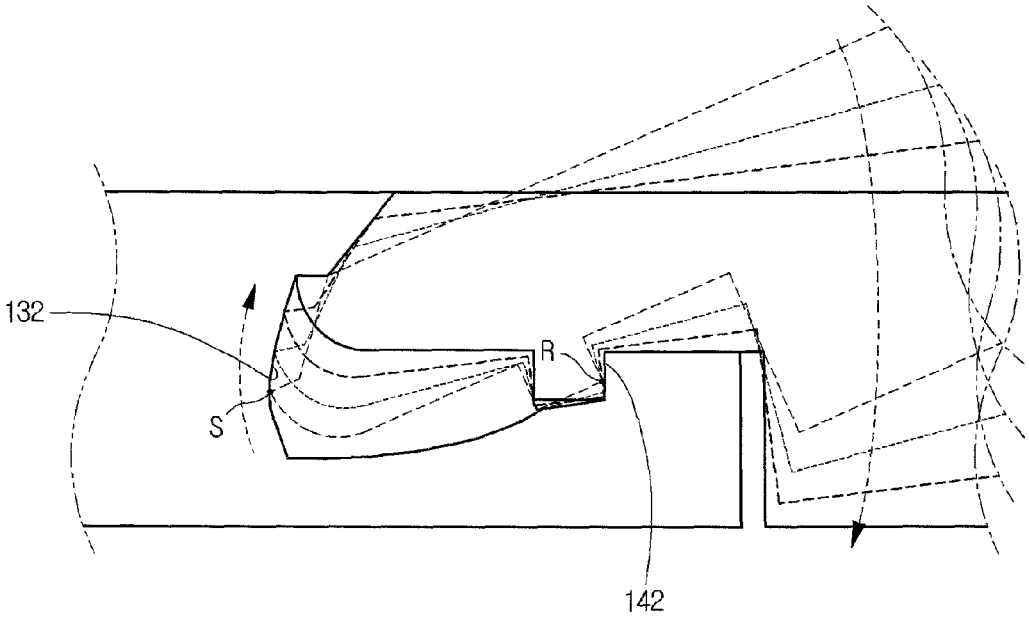
FIGS. 9 and 10 are side sectional views explaining a coupling mechanism of the tongue part and the recessed part provided in the floorboard according to the embodiment illustrated in FIG. 3.

FIG. 9 is a view illustrating a stepwise sequence of pivotally rotating the tongue protrusion 210 upward in a state in which the tongue part 200 is inserted into the recessed part 100. As illustrated in FIG. 9, when the tongue part 200 is pivotally rotated in the recessed part 100, the end S of the tongue protrusion 210 is moved upward along the guide wall 132 and the outer corner R of the raised retaining portion 220 is moved downward along the inner wall 142 of the raised portion 140.

Figure 10:
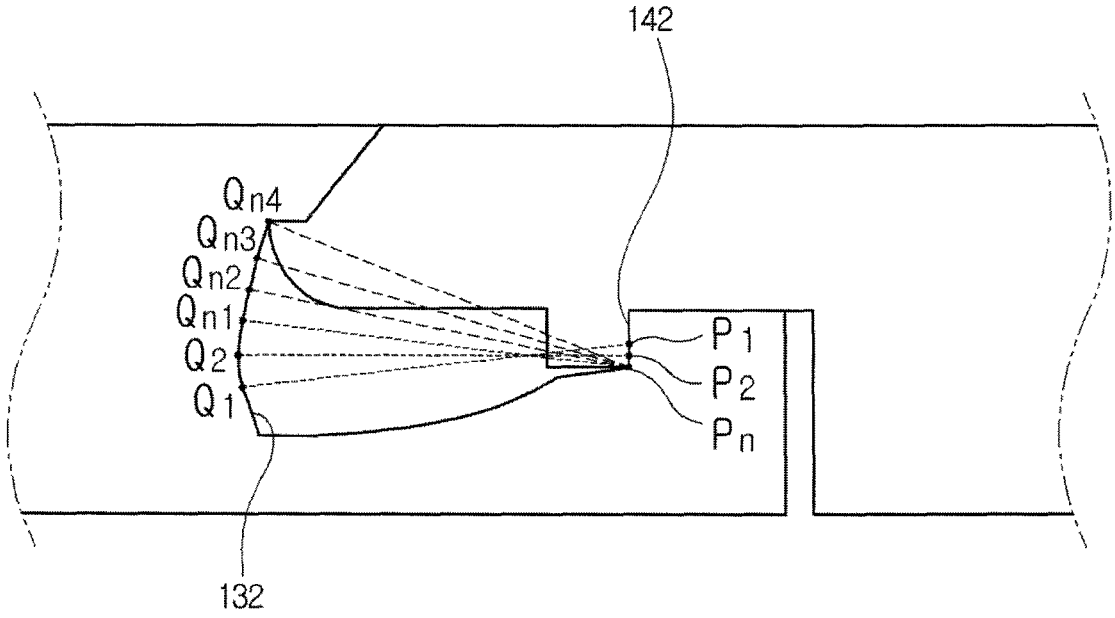

FIG. 10 illustrates several points on a movement path of the end S of the tongue protrusion 210 and several points on a movement path of the outer corner R of the raised retaining portion 220.

In FIG. 10, $P_1$, $P_2$, . . . $P_n$ represent the points on the movement path of the outer corner R of the raised retaining portion 220 of the tongue part 200, and $Q_1$, $Q_2$, . . . $Q_{n1}$, $Q_{n2}$, $Q_{n3}$, $Q_{n4}$ represent the points on the movement path of the end S of the tongue protrusion 210 of the tongue part 200.

Here, $P_1$ corresponds to $Q_1$, $P_2$ corresponds to $Q_2$, and $P_n$ corresponds to $Q_{n1}$, $Q_{n2}$, $Q_{n3}$, $Q_{n4}$.

Specifically, if the outer corner R of the raised retaining portion 220 is located at the point $P_1$ via rotation of the tongue part 200, the end S of the tongue protrusion 210 is located at the point $Q_1$. Then, if the outer corner R of the raised retaining portion 220 is located at the point $P_2$, the end S of the tongue protrusion 210 is located at the point $Q_2$.

Thereafter, if the outer corner R of the raised retaining portion 220 is located at the point $P_n$, the end S of the tongue protrusion 210 is pivotally rotated about the point $P_n$ along the points $Q_{n1}$, $Q_{n2}$, $Q_{n3}$, $Q_{n4}$ until the hook portion 211 is caught by the ceiling portion 111. In this way, coupling between the tongue part 200 and the recessed part 100 is completed.

When the tongue part 200 is introduced into the space 130 of the recessed part 100 and is initially rotated, the tongue part 200 is rotated about an intersection point of a line connecting the points $P_1$ and $Q_1$ to each other and a line connecting the points $P_1$ and $Q_1$ to each other, which allows the end S of the tongue protrusion 210 to slide along the guide wall 132 and the outer corner R of the raised retaining portion 220 to slide along the inner wall 142 of the raised portion 140.

Then, after the outer corner R of the raised retaining portion 220 reaches the point $P_n$, the point $P_n$ is fixed as a rotation center point and the end S of the tongue protrusion 210 is moved along the guide wall 132 to draw an arc passing through the points $Q_{n1}$, $Q_{n2}$, $Q_{n3}$, $Q_{n4}$.

Thus, the guide wall 132 preferably has a shape conforming to the arc as illustrated in FIG. 10 and in other words, has substantially the same contour as the arc drawn by the end S of the tongue protrusion 210.

Next, another embodiment of the floorboard according to the present invention will be described with reference to FIG. 11.

Figure 11:
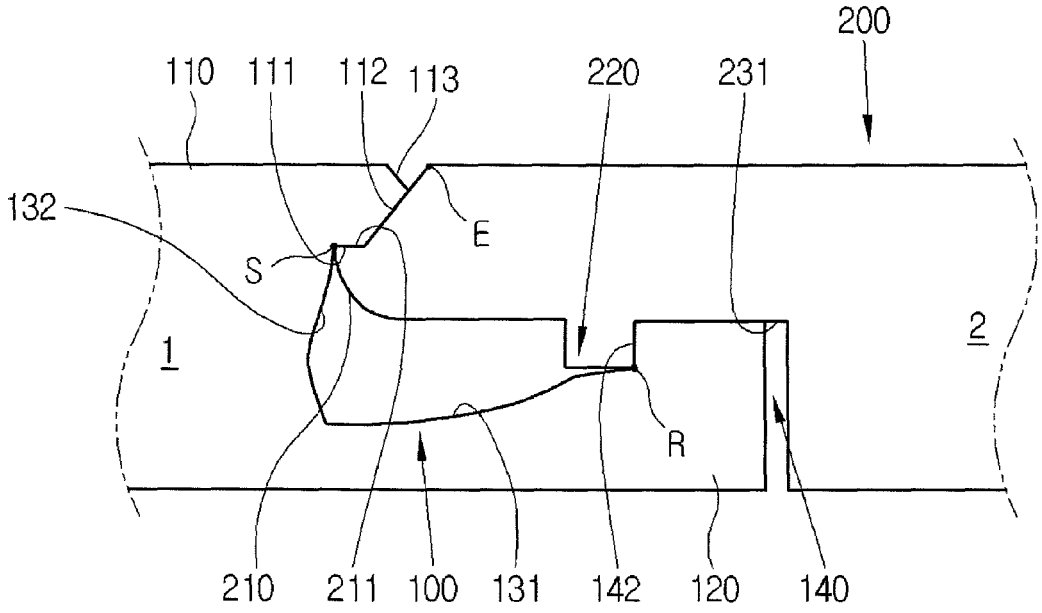
FIG. 11 is a side sectional view illustrating a tongue part and a recessed part provided in the floorboard according to another embodiment of the present invention.

The floorboard illustrated in FIG. 11 is basically identical to the floorboard illustrated in FIG. 3, but has a difference with regard to a configuration of the upper lip 110 of the recessed part 100.

As illustrated in FIG. 11, the upper lip 110 of the recessed part 100 preferably further includes a bevel portion 113 inclined in a direction opposite to the guide portion 112.

When the recessed part 100 is provided with the bevel portion 113, the bevel portion 113 defines a substantially "V"-shaped groove along with the extension portion 212 of the tongue part 200 when the tongue part 200 is completely coupled with the recessed part 100, which can provide the constructed floorboard with a more aesthetically pleasing appearance.

Other configurations of the floorboard according to the present embodiment except for the bevel portion 113 are identical to those as illustrated in FIG. 3 and thus, a detailed description thereof will be omitted herein.

Next, a further embodiment of the floorboard according to the present invention will be described with reference to FIGS. 12 and 13.

Figure 12:
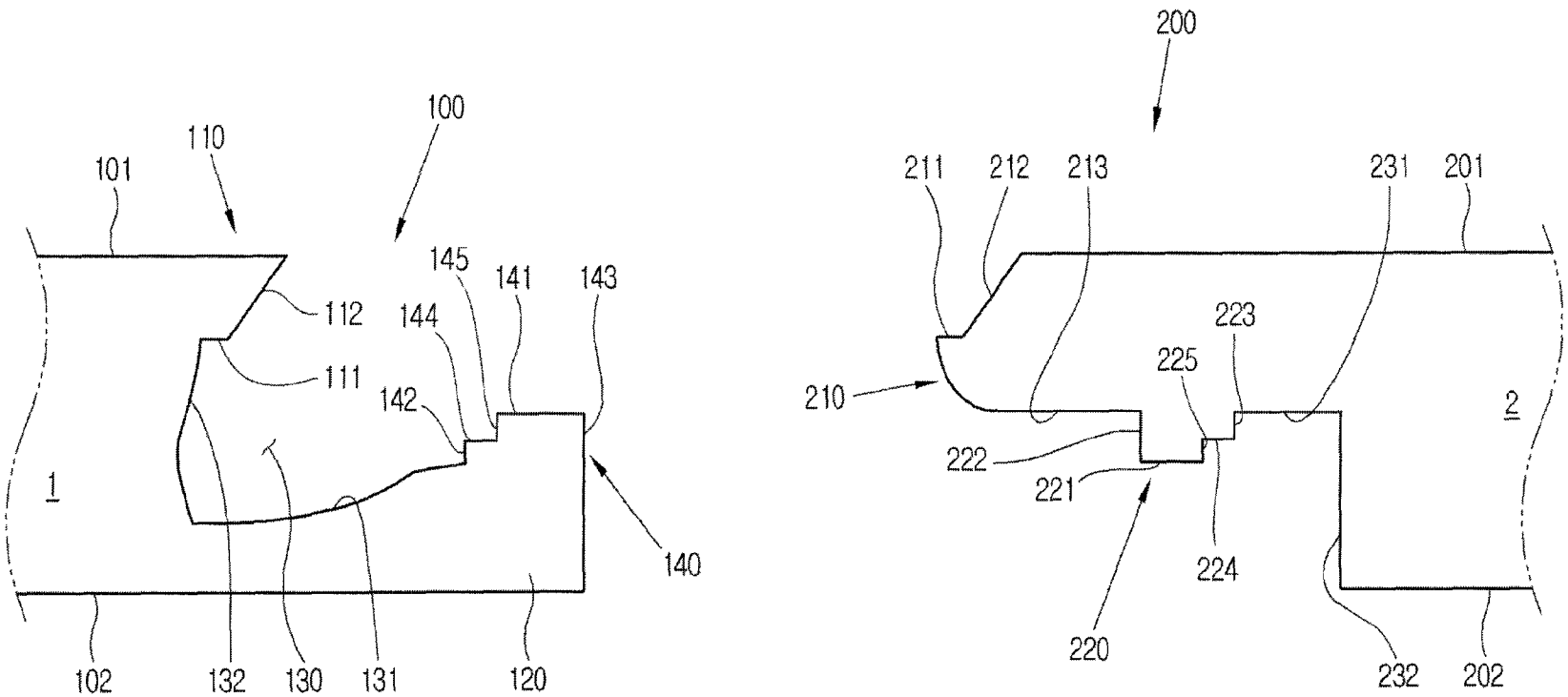
FIG. 12 is a side sectional view illustrating a tongue part and a recessed part provided in the floorboard according to a further embodiment of the present invention.
Figure 13:
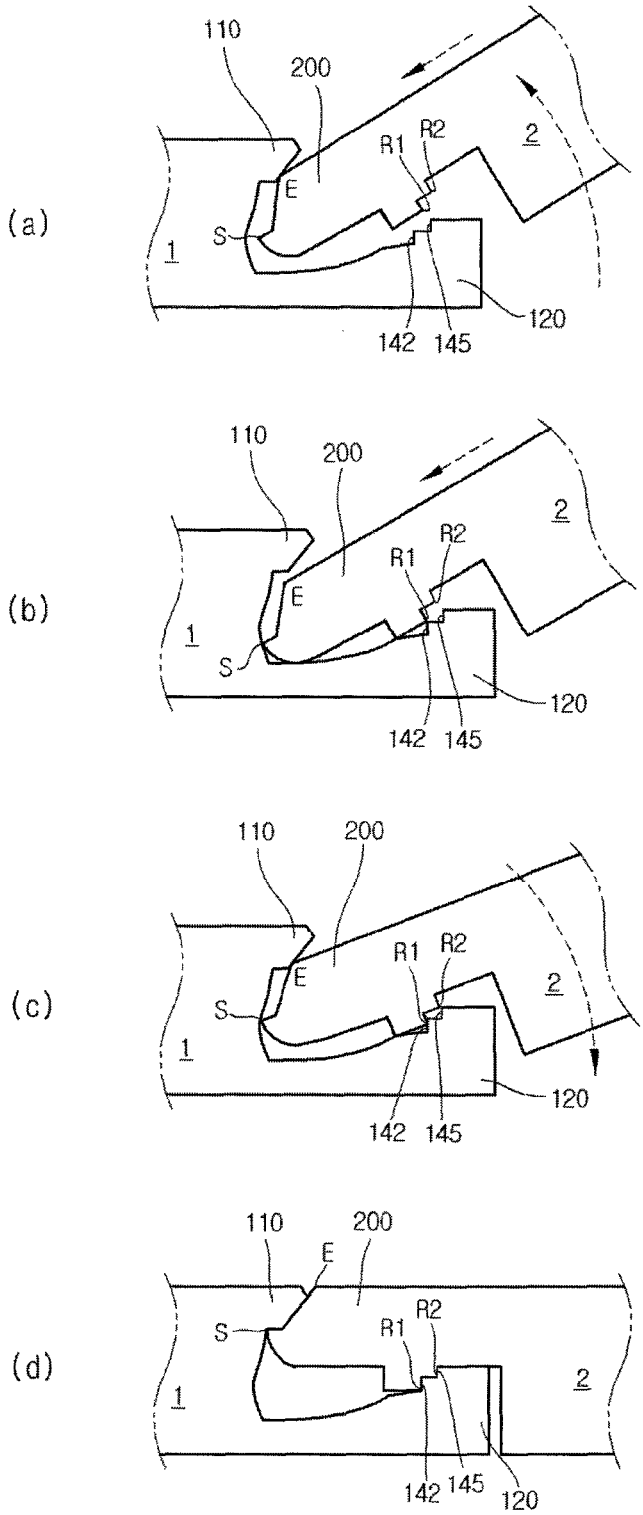
FIG. 13 is a side sectional view illustrating a stepwise coupling sequence of the tongue part and the recessed part provided in the floorboard according to the embodiment illustrated in FIG. 12.

The floorboard according to the embodiment illustrated in FIGS. 12 and 13 is basically identical to the floorboard of the embodiment illustrated in FIG. 3, except for a configuration of the raised portion 140 of the recessed part 100 and the raised retaining portion 220 of the tongue part 200. Thus, the following description centers only on a difference therebetween and other configurations of the floorboard according to the present embodiment will not be described hereinafter because they are identical to those of the embodiment illustrated in FIG. 3.

As illustrated in FIG. 12, the raised portion 140 of the recessed part 100 includes stepped portions 144 and 145, which define a substantially step shaped portion between the inner wall 142 and the upper end 141 of the raised portion 140. To correspond to the stepped portions 144 and 145, the raised retaining portion 220 of the tongue part 200 includes stepped portions 224 and 225, which define a substantially step shaped portion between the outer wall 223 and the lower end 221 of the raised retaining portion 220.

The stepped portions of the recessed part 100 include a stepped bottom portion 144 and a stepped sidewall portion 145, and the stepped portions of the tongue part 200 include a stepped bottom portion 224 and a stepped sidewall portion 225.

An assembly sequence of the floorboard according to the embodiment illustrated in FIG. 12 is identical to that illustrated in FIG. 13.

FIG. 13(*a*) illustrates a state in which the tongue part 200 of one flooring panel, which is pivotally rotated upward so as to be obliquely oriented, is introduced into the recessed part 100 of another flooring panel such that the tongue protrusion 210 is inserted toward the bottom portion 131 of the recessed part 100. FIG. 13(*b*) illustrates a state in which the tongue part 200 is completely inserted into the space 130 of the recessed part 100 (i.e. the upper corner E of the tongue part 200 is located below the upper lip 110, the tongue protrusion 210 is located at a lower position of the guide wall 132, and the raised retaining portion 220 is completely located inside the raised portion 140).

FIG. 13(*c*) illustrates a process of rotating the tongue part 200 within the space 130 of the recessed part 100 such that the tongue protrusion 210 is moved upward. FIG. 13(*d*) illustrates a state in which the tongue part 200 is completely coupled with the recessed part 100.

The basic assembly mechanism, i.e. the assembly sequence of the present embodiment is identical to the assembly mechanism of the floorboard according to the embodiment illustrated in FIGS. 5 to 8. The present embodiment has a feature in that, with provision of the stepped portions 224 and 225 of the raised retaining portion 220 and the stepped portions 144 and 145 of the raised portion 140, corners $R_1$ and $R_2$ of the raised retaining portion 220 are adapted to slide on the corresponding inner wall 142 and stepped sidewall portion 145 respectively.

In the present embodiment, the end S of the tongue protrusion 210 moves in the same arc as that in the embodiment illustrated in FIGS. 5 to 8.

When tongue part 200 is pivotally rotated in the recessed part 100, the end S of the tongue protrusion 210 slides upward along the guide wall 132 as the corner $R_1$ slides downward along the inner wall 142. After the corner $R_2$ comes into contact with the stepped sidewall portion 145, the corner $R_2$ slides downward along the stepped sidewall portion 145.

Once the tongue part 200 is completely coupled with the recessed part 100, preferably, the inner wall 142 of the raised portion 140 comes into contact with the stepped sidewall portion 225 of the raised retaining portion 220, the stepped bottom portion 144 of the raised portion 140 comes into contact with the stepped bottom portion 224 of the raised retaining portion 220, the stepped sidewall portion 145 of the raised portion 140 comes into contact with the outer wall 223 of the raised retaining portion 220, and the upper end 141 of the raised portion 140 comes into contact with the ceiling portion 231 of the accommodating portion 230.

As is apparent from the above description, the present invention provides a floorboard in which neighboring flooring panels are assembled with each other using a new assembly method completely different from a conventional flooring panel assembly method. The floorboard according to the present invention has the effects of providing simplified assembly of flooring panels without damage because it is unnecessary to apply external force to assemble the flooring panels and of achieving enhanced coupling force in a horizontal direction after assembly of the flooring panels.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A floorboard comprising a tongue part protruding from one side of a first flooring panel and a recessed part provided at one side of a second flooring panel for insertion and assembly of the tongue part, wherein the tongue part includes a tongue protrusion having a predetermined length, a tongue bottom portion extending from the tongue protrusion to define the bottom of the tongue part, and a raised retaining portion protruding downward from the tongue bottom portion, wherein the recessed part includes an upper lip defining the ceiling of the recessed part, the tongue protrusion being caught by the upper lip as the tongue part is inserted into and rotated in the recessed part, a lower lip defining a bottom portion of the recessed part, a raised portion protruding upward from an end of the lower lip, and a guide wall defining an inner wall of the recessed part, the guide wall having the same contour as an arc drawn by an end of the tongue protrusion as the tongue part is introduced into a space between the upper lip and the lower lip and is pivotally rotated, wherein the upper lip of the recessed part includes a ceiling portion provided with a substantially horizontal surface, and a guide portion provided with an inclined surface protruding outward from the ceiling portion to an uppermost end of the upper lip, wherein the tongue protrusion of the tongue part includes a hook portion corresponding to the ceiling portion, and an extension portion extending upward from the hook portion to an uppermost end of the tongue part to be inclined corresponding to the guide portion, wherein the recessed part has the space defined by the upper lip, the guide wall, the lower lip and the inner wall of the raised portion such that the tongue part is inserted into the space for the tongue protrusion to be located below the upper lip and the raised retaining portion to be located inside the space over the raised portion simultaneously as the guide portion of the recessed part serves to guide the extension portion of the tongue part before the tongue part is pivotally rotated, wherein the raised portion is formed on a position on which the raised retaining portion is not able to fit into the raised portion as an arc drawn by an outer corner of the raised retaining portion passes through an upper end of the raised portion if the tongue part is rotated on a point where the end of the upper lip and an upper corner of the tongue part come into contact with each other, while the raised retaining portion is able to fit into the raised portion as an outer corner of the raised retaining portion slides downward along the inner wall of the raised portion and an end of the tongue protrusion is pivotally rotated upward along the guide wall such that the tongue protrusion is caught by the upper lip if the tongue part is rotated on a pivot point where the outer corner of the raised retaining portion comes into contact with the inner wall of the raised portion, and wherein the tongue part and the recessed part are assembled with each other as the tongue part is inserted into the space of the recessed part and is pivotally rotated on the pivot point.

2. The floorboard according to claim 1, wherein a length of the guide wall is greater than a vertical length from the end of the tongue protrusion to a lower end of the raised retaining portion.

3. The floorboard according to claim 2, wherein the bottom portion of the recessed part is reduced in height from the inner wall of the raised portion to the guide wall.

4. A floorboard comprising a tongue part protruding from one side of a first flooring panel and a recessed part provided at one side of a second flooring panel for insertion and assembly of the tongue part, wherein the recessed part includes an upper lip defining the ceiling of the recessed part, a lower lip defining a bottom portion of the recessed part, and a raised portion protruding upward from an end of the lower lip, wherein the tongue part includes a tongue protrusion which is caught by the upper lip as the tongue part is inserted into and is pivotally rotated upward in the recessed part, a tongue bottom portion extending from the tongue protrusion to define the bottom of the tongue part, and a raised retaining portion protruding downward from the tongue bottom portion, wherein the upper lip of the recessed part includes a ceiling portion provided with a substantially horizontal surface, and a guide portion provided with an inclined surface protruding outward from the ceiling portion to an uppermost end of the upper lip, wherein the tongue protrusion of the tongue part includes a hook portion corresponding to the ceiling portion, and an extension portion extending upward from the hook portion to an uppermost end of the tongue part to be inclined corresponding to the guide portion, wherein the recessed part has a space defined by the upper lip, the lower lip and the inner wall of the raised portion such that the tongue part is inserted into the space for the tongue protrusion to be located below the upper lip and the raised retaining portion to be located inside the space over the raised portion simultaneously as the guide portion of the recessed part serves to guide the extension portion of the tongue part before the tongue part is pivotally rotated, wherein the raised retaining portion is formed on a position on which the raised retaining portion is not able to fit into the raised portion as an arc drawn by an outer corner of the raised retaining portion passes through an upper end of the raised portion if the tongue part is rotated on a point where the end of the upper lip and an upper corner of the tongue part come into contact with each other, while the raised retaining portion is able to fit into the raised portion as an outer corner of the raised retaining portion slides downward along the inner wall of the raised portion and an end of the tongue protrusion is pivotally rotated upward toward a lower end of the upper lip such that the tongue protrusion is caught by the upper lip if the tongue part is rotated on a pivot point where the outer corner of the raised retaining portion comes into contact with the inner wall of the raised portion, and wherein the tongue part and the recessed part are assembled with each other as the tongue part is inserted into the space of the recessed part and is pivotally rotated on the pivot point.

5. The floorboard according to claim 4, wherein the recessed part further includes a guide wall defining an inner wall thereof to define the space, the guide wall serving to guide rotation of an end of the tongue part along an arc when the tongue part is introduced into the space and is pivotally rotated about the pivot point where the raised retaining portion comes into contact with the inner wall of the raised portion.

6. The floorboard according to claim 4, wherein the tongue part further includes an accommodating portion, into which the raised portion is accommodated as the raised retaining portion is caught by the raised portion when the tongue part is assembled with the recessed part.

7. The floorboard according to claim 6, wherein a height from a lower end of the first flooring panel to an upper end of the raised portion of the recessed part is substantially equal to a height from a lower end of the second flooring panel to the ceiling of the accommodating portion of the tongue part.

8. The floorboard according to claim 4, wherein an angle between the inner wall of the raised portion and a horizontal plane substantially satisfies the following relationship:

$$80° \leqq \theta 1 \leqq 100°.$$

9. The floorboard according to claim 4, wherein an angle between a lower end and an outer wall of the raised retaining portion substantially satisfies the following relationship:

$$80° \leqq \theta 2 \leqq 100°.$$

10. The floorboard according to claim 4, wherein a width of the bottom portion of the recessed part is substantially equal to or greater than a length from the end of the tongue protrusion of the tongue part to a corner where a lower end and an outer wall of the raised retaining portion meet each other.

11. The floorboard according to claim 4, wherein an angle between an upper end and an outer wall of the raised portion substantially satisfies the following relationship:

$$80° \leqq \theta 3 \leqq 100°.$$

12. The floorboard according to claim 4, wherein the raised portion includes at least one stepped portion defining a substantially step shaped portion between the inner wall and an upper end of the raised portion, and wherein the raised retaining portion includes at least one stepped portion defining a substantially step shaped portion between an outer wall and a lower end of the raised retaining portion.

13. The floorboard according to claim 4, wherein the upper lip further includes a bevel portion inclined in a direction opposite to the guide portion.

14. The floorboard according to claim 4, wherein the flooring panel is made of any one of wood, plywood, Particle Board (PB), Medium Density Fiberboard (MDF), High Density Fiberboard (HDF), Poly Vinyl Chloride (PVC), and mixtures thereof.

15. The floorboard according to claim 4, wherein at least one of a decorative layer and a protective layer is formed on at least one of an upper end and a lower end of each flooring panel.

* * * * *